United States Patent [19]

Hughes, deceased

[11] 4,322,720

[45] Mar. 30, 1982

[54] DISPLAY DEVICES

[75] Inventor: Gordon Hughes, deceased, late of Macclesfield, England, by Margaret Hughes, Mabel Mottershead, legal representative

[73] Assignee: International Computers Limited, London, England

[21] Appl. No.: 5,916

[22] Filed: Jan. 23, 1979 (Under 37 CFR 1.47)

[30] Foreign Application Priority Data

Jan. 28, 1978 [GB] United Kingdom ..... 3574/78

[51] Int. Cl.[3] ..... G08B 5/36

[52] U.S. Cl. ..... 340/825.81; 250/209; 340/719; 340/781

[58] Field of Search ..... 340/166 EL, 718, 719, 340/781, 795; 250/209

[56] References Cited

U.S. PATENT DOCUMENTS

| | | | |
|---|---|---|---|
| 3,152,257 | 10/1964 | Santen et al. | 250/209 |
| 3,207,905 | 9/1965 | Bray | 340/718 X |
| 3,221,170 | 11/1965 | Sylvander | 250/209 |
| 3,375,373 | 3/1968 | Hageman | 250/209 |

*Primary Examiner*—David L. Trafton

*Attorney, Agent, or Firm*—Hane, Roberts, Spiecens & Cohen

[57] ABSTRACT

A display device formed as a multilayer panel. The display is built up of d.c. electroluminescent display elements arranged in cells each containing an array of elements, e.g. for the display of a character. A display element is selected and caused to start luminescing by (a) a flash of light from a cell selector d.c. electroluminescent element which lowers the resistance of a group of associated photoconductors in series with the display elements, and (b) an energizing pulse applied, in the cell in question, to one of the display elements through its photoconductor. Once initiated, luminescence is maintained by an energizing voltage applied through a photoconductor radiatively coupled to the element. The information written in a cell is selectively erased as a whole by a further flash from the cell-selector element, which reduces the voltage applied to the lit elements of the cell to the point at which luminescence ceases. The photoconductors are arranged back-to-back on either side of an opaque printed circuit board and connected to each other and the display elements by through-layer connections.

9 Claims, 6 Drawing Figures

DISPLAY DEVICES

BACKGROUND OF THE INVENTION

This invention relates to display devices, and especially to display devices in which a display is built up by the selective illumination of individual elements. Such a device may, for example, be used for the display of character information.

It has been proposed to use d.c. electroluminescent elements as the individual elements. The selected elements are illuminated by repeatedly scanning the display elements in sequence, energising those required once each scan. Such a method requires complicated and powerful drive circuitry and inposes an inherent limitation on the number of elements in the display if the brightness of a bit element is not to fall below acceptable limits.

A display device has also been proposed using a.c. electroluminescent elements arranged in groups. Each group may be selected by closing a switch to apply an alternating voltage to a further a.c. electroluminescent element which thus lights and lowers the resistance of photoconductors coupled in series with the elements of the group. The particular element is selected by closing a switch so that the voltage is applied across that element through the photoconductor in series with it, whose resistance has been lowered. The voltage is then enough to cause the element to start to emit light. The light lowers the resistance of a further photoconductor in series with the element to the point at which the alternating voltage, applied through this photoconductor, can maintain the emission. Hence in this device an element once selected will remain set.

Emission is stopped by removing the alternating supply voltage—that is, all the lit elements will cease to be lit.

Such an arrangement prevents part only of the information on the display being removed. For a character display, for instance, that prevents one character only being selectively erased and rewritten without also rewriting all the unchanging information.

SUMMARY OF THE INVENTION

This invention provides a display arrangement comprising a first radiative element, a first photoconductive element radiatively coupled to the first radiative element, a second radiative element and a second photoconductive element radiatively coupled to the second radiative element, the first and second photoconductive elements being coupled in series with the second radiative element in separate branches coupled to the same electrode of the second radiative element, the arrangement being such that in operation production of radiation by the second radiative element is initiated by applying radiation from the first radiative element to the first photoconductive element and, while its resistance is lowered as a result, applying an energising potential to the series combination of the first photoconductive element and the second radiative element of the magnitude sufficient to initiate production of radiation from the second element while the resistance of the first photoconductive element is lowered but not otherwise, production of radiation from the second element, once initiated, is maintained by an energising potential applied across the series combination of the second photoconductive element and the second radiative element the magnitude of which is sufficient to maintain production of radiation and with the resistance of the second radiation producing elementlowered as a result, but not to initiate production of radiation if the resistance of the second photoconducting element is not lowered, and production of radiation by the second radiative element is terminated by applying radiation from the first radiative element to the first photoconductive element so as to lower its resistance, the arrangement being such that the energising potential applied across the second radiative element is thereby reduced to a point such that the production of radiation ceases to be maintained.

BRIEF DESCRIPTION OF THE DRAWINGS

A display device in accordance with the invention and including an arrangement in accordance with it for selecting individual elements will now be described by way of example in greater detail with reference to the accompanying drawings, in which.

DESCRIPTION OF THE PREFERRED EMBODIMENT

Figure 1:
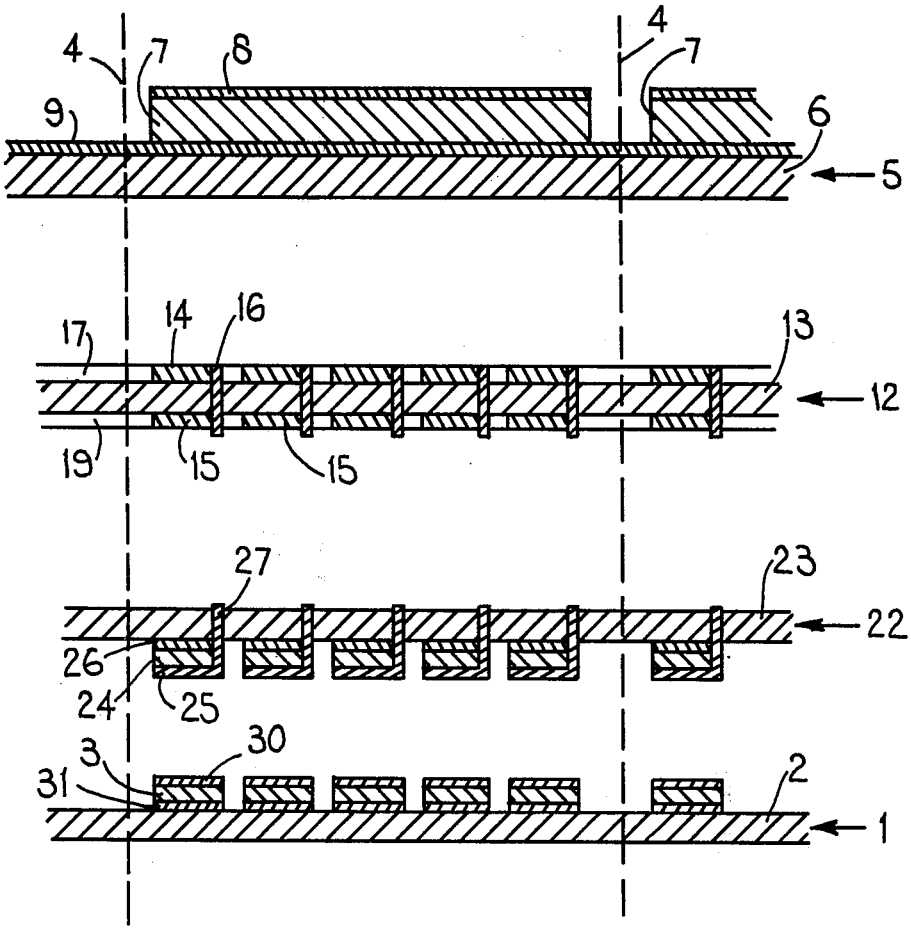
FIG. 1 is a section through the device.

Referring to FIG. 1, the display device is a panel formed as a multilayer stack. The layers are shown separated for convenience, but in an assembled panel are bonded or otherwise secured to one another. The front layer (that is, the one nearest the observer), is a layer 1 which consists of a transparent substrate 2 carrying electroluminescent elements 3. These elements are grouped in cells which in FIG. 1 are shown bounded by dotted lines 4. Within each cell the elements are arranged in a regular array; the cells themselves are also arranged in a regular array.

It will be assumed for the present that each cell is intended to display a character by the selective excitation of some of its constituent elements 3 in the well-known dot matrix manner; but, as will be explained, the display device can be used in other ways.

Figure 2:
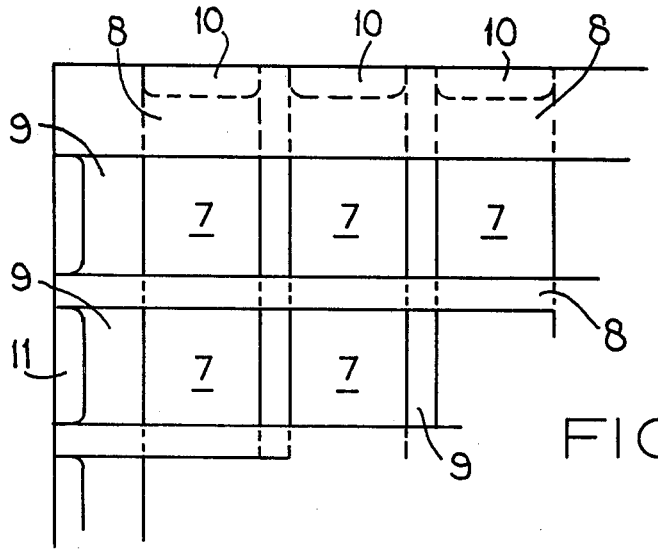
FIG. 2 is a diagrammatic representation of the interconnections in one layer of the device.

The layer furthest from the observer is a layer 5 consisting of a transparent substrate 6 carrying electroluminescent elements 7. Each element 7 covers approximately the whole of a character cell. It is connected between two conductors 8 and 9 which form its electrodes. The conductors 8 and 9 are orthogonal strips which join the elements 7 in rows and columns and end in edge connectors 10 and 11 at the edge of the layer (see also FIG. 2).

The layer next to the layer 5, is a layer 12, consisting of an opaque substrate 13 carrying photoconductors 14 on the face nearer the layer 5 and photoconductors 15 on the opposite face. The photoconductors 14 and 15 are aligned with the electroluminescent elements 3 which form the dots of the character. The photoconductors 14 are radiatively coupled to (that is, receive radiation from) the electroluminescent elements 7 and are each connected between a through-connector 16 and a column conductor 17. The conductors 17 connect the photoconductors 14 in columns which span the panel and double back making contact with the mirror-image column of photoconductors in the neighbouring column of cells (see also FIG. 3 in which, for simplicity, only a four-by-four array is shown for the character cell: in practice the array will be likely to be larger). Each conductor 17 ends in an edge connector 18. This arrangement interconnects the columns of photoconductors 14 in different cells without the need for crossovers.

The photoconductors 15 are each connected between the through-connector 16 from the associated photoconductor 14 and a common conductor 19 which is taken to a single edge connector 20 (not shown).

The layer 12 may be manufactured as a double-sided printed circuit board. Its substrate 13 is opaque in order to isolate the two optical systems above and below it.

The neighbouring layer is a layer 22 which consists of a transparent substrate 23 carrying electroluminescent elements 24 aligned with the dot positions of the character. Each element 24 is radiatively coupled to the photoconductor 15 aligned with it and is connected between a conductive coating 25 and a row conductor 26; these conductors form its electrodes. The coating 25 is connected to a through-connector 27 which makes contact with the corresponding through-connector 16. The row conductors 26, which end in edge connectors 28, connect the elements 24 together in rows spanning the panel and doubling back in a similar manner to the column conductors 14 (see also FIG. 3).

The electroluminescent elements 3 of the front layer 1 each have a conductive coating 30 which makes contact with the conductive coating 25 of the associated element 24 of the neighbouring layer 22. This coating 30 forms one electrode of the element 3; the other is a conductor 31 which has the same configuration as the row conductor 26 of the associated element 24 and is joined to it at the edge of the panel. The elements 25 and 3 are thus connected in parallel.

All the electroluminescent elements 3, 7 and 24 are d.c. electroluminescent elements formed by the powder deposition of a suitable phosphor. The elements 3 provide visible illumination and may for example be a zinc sulphide phosphor; the elements 7 and 24 are chosen to emit radiation of a spectral distribution which matches more closely the sensitivity of the associated photoconductors 14 and 15, which are chosen to have a rapid response and may for example be of cadmium selenide.

Figure 4:
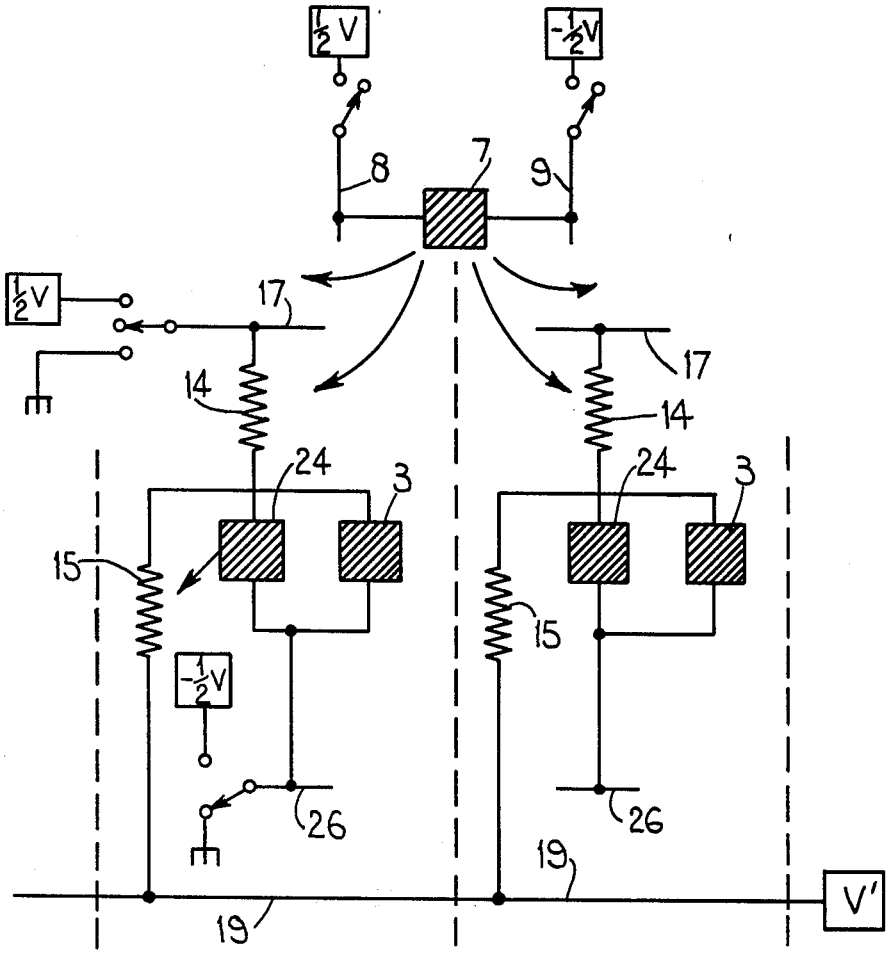
FIG. 4 is a circuit diagram corresponding to FIG. 1.
Figure 5:
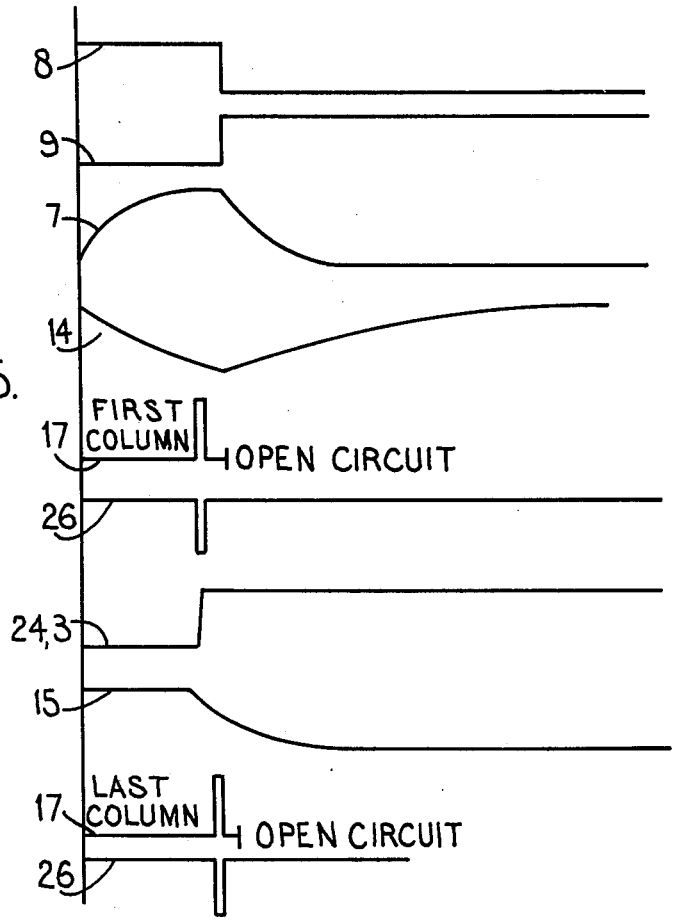
FIGS. 5 and 6 are timing diagrams.

The manner in which a particular element 3 is selected and lit will now be described with reference to the circuit diagram of FIG. 4 and the timing diagram of FIG. 5. In FIG. 5 (as also in FIG. 6) the curves are given the reference numerals of the elements to which they apply. Those for conductors show the potentials applied to them; those for photoconductors show their resistance; those for the electroluminescent elements show their brightness.

First, the character cell containing the desired element 3 is selected by applying opposite-polarity partial d.c. pulses to the conductors 8 and 9 which cross at the desired cell. The element 7 in that cell receives a full voltage pulse as an energising potential and is caused to luminesce. The remaining elements 7 do not emit a significant amount of radiation. The radiation from the luminescing cell 7 strikes all the photoconductors 14 of that cell and causes their resistance to fall. When their resistance is sufficiently low, opposite-polarity partial d.c. pulses are applied to the pair of row and column conductors 26 and 17 which cross at the position of the element to be selected. With the lowered resistance of the photoconductor 14 the full voltage applied is sufficient to excite the element 24 at that point to luminesce and the radiation produced lowers the resistance of the associated photoconductor 15. A maintaining energisation potential in the form of a pulsed d.c. voltage is applied to the conductor 19 and thus to all the elements 15. When the voltage pulses applied to the row and column conductors 26 and 17 cease, the connection to the conductor 17 is opencircuited, and the potential from the conductor 19 is then sufficient, applied through the lowered resistance of the photoconductor 15, to cause the element 24 to luminesce. That in turn maintains the resistance of the photoconductor 15 low. The rate of pulsing of the conductor 19 is sufficiently high for the resistance of the photoconductor 15 not to rise significantly between pulses and the element 24 is thus maintained in a state of apparently continuous luminescence.

The electroluminescent element 3 connected in parallel with the selected element 24 is subjected to the same potential and luminesces at the same time as it to produce visible radiation. It is perfectly acceptable for part of the radiation it produces to contribute to the response of the photoconductor 15.

The other elements of the selected cell do not receive the full voltage pulse and are not caused to luminesce, even though the resistance of their associated photoconductor is lowered. The voltage pulse applied to the selected element is also applied to one element in each other cell, but as the resistance of their associated photoconductors 14 is not lowered by radiation from the associated cell-selector element 7 they too are not caused to luminesce. (If already luminescing they will not be affected). The arrangement thus functions as a four-input AND gate. Owing to the non-linear characteristics of the various components partially selected elements do not produce luminescence which is significant, that is, sufficient to establish maintained luminescence.

Figure 3:
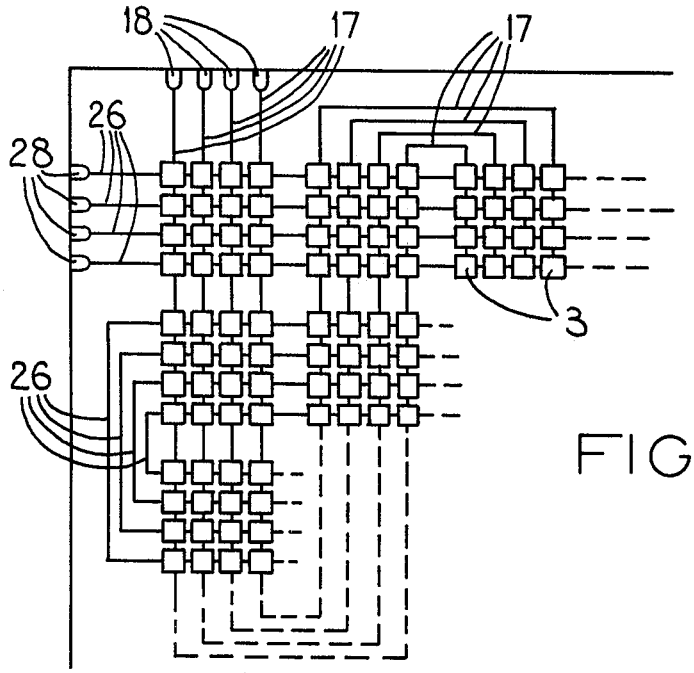
FIG. 3 is a diagrammatic representation of interconnections in other layers of the device.

The drive circuitry is shown on FIG. 3 as switches for carrying out the described functions, and may be constructed of conventional transistor circuitry, preferably in an integrated-circuit form.

To display a complete character, while the resistance of the photoconductor 14 for the selected cell is low, the column conductors 17 are pulsed in turn to scan across the cell and the appropriate row conductors 26 are pulsed in synchronism with each column pulse to produce the correct dot pattern for that column. The dot pattern may be stored in a read-only memory in the known manner.

When one character has been written in its cell the next character may be written in another cell as soon as the resistance of the photoconductors 14 of the first cell has risen to the point at which their associated elements will not be caused to luminesce by the selection pulses applied to the row and column conductors 26 and 17 and intended for the next character.

To write characters in different cells the drive logic compensates for the way the row and column conductors double back along the mirror image line of elements in the neighbouring line of cells. Thus, when changing from a cell to its neighbour in the adjacent column the order of scanning or of reading out the dot column is inverted; when changing from a cell to its neighbour in the adjacent row the order of connections with the row conductors is inverted.

Figure 6:
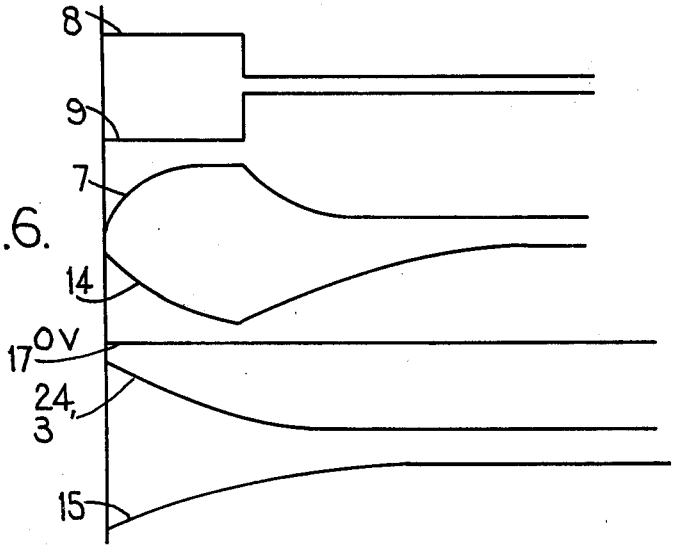

Referring to FIG. 6, the elements 24 and 3 of a cell may be switched off simply by producing a pulse of light from the associated cell-selector element 7 while the row and column conductors 26 and 17 are maintained at Ov. The lowering of the resistance of the associated photoconductor 14 then reduces the energisation potential across the elements 24 and 3 and causes significant luminescence to cease. This offers an extremely flexible way of controlling switch-off, since, by suitable choice of the conductors 8 and 9 to pulse, individual characters, whole rows or columns of characters, or the entire display may be erased.

It will be understood that although the panel has been described as for displaying characters, the drive method is equally applicable to displays in which the display elements, as far as the user is concerned, form a uniform array, for example as in a graphics display. In this case the division into cells will not be apparent to the user.

It has been proposed to manufacture a character display in which there is an array of d.c. electroluminescent elements connected between two sets of orthogonal conductors. Each element luminesces when the two conductors between which it is connected are changed in potential. In this arrangement the entire array is scanned with a pulse drive. Its average brightness depends on the duty cycle used. In comparison, the display device described above has the advantage that the brightness of an element results from the maintaining energisation and is not affected by the number of elements in the panel. In the prior arrangement the individual elements are maintained lit by pulses applied through drive elements such as transistors to selection lines. In this display the drive elements apply pulses only for the initial addressing, and thus have a much smaller average current. They can therefore be of a much lower power rating.

The inclusion of selection logic in the panel reduces the number of drive lines as compared with the two-selection-line arrangement, and this in turn reduces the total cost of the drive elements such as transistors, which can be a considerable part of the total cost of the device. The selection is performed by simple passive elements which can be manufactured easily by the same technique as is used for the other emitting layers of the display.

Various other modifications are possible. Instead of doubling back the row and column conductors each one may be taken to the edge and the appropriate rows and columns from the different lines of cells joined by off-panel connectors. The row and column conductors 24 and 17 could be interchanged, so that the photoconductors 14 are connected to the row conductors. Whether the row or column conductors are scanned to write the character in its cell is a matter of convenience depending on the character generation logic.

The pulsed drive applied to the conductor 19 increases the life of the electroluminescent elements; however, if desired, a constant d.c. maintaining voltage may be used.

Possible alternative radiative elements are a.c. electroluminescent elements, light-emitting diodes, and light-controlling elements such as liquid crystals.

I claim:

1. A display arrangement comprising a first radiative element, a first photoconductive element radiatively coupled to the first radiative element, a second radiative element, a second photoconductive element radiatively coupled to the second radiative element, the first photoconductive element being coupled between a first electrode of the second radiative element and a first selection line and a second electrode of the second radiative element being coupled to a second selection line, the second photoconductive element being coupled to the said first electrode of the second radiative element, means for applying a pulse of energisation potential to the first radiative element whereby it produces a pulse of radiation and lowers the resistance of the first photoconductive element, means for applying a partial energisation pulse to the first selection line and means for applying a partial energisation pulse to the second selection line whereby there is applied across the series combination of the first photoconductive element and the second radiative element an energisation potential sufficient to initiate the production of radiation by the second radiative element when the resistance of the first photoconductive element is lowered by the said pulse of radiation but insufficient when that resistance is not so lowered, the resistance of the second photoconductive element being lowered by the said radiation produced by the second radiative element, means for applying an energisation potential across the series combination of the second photoconductive element and second radiative element of a magnitude sufficient to maintain production of radiation from the second radiative element when the resistance of the second photoconductive element has been lowered by the said radiation produced by the second radiative element but insufficient when that resistance is not so lowered, and means for connecting the said first selection line, at a time when production of radiation by the second radiative element is being maintained, to a potential different from that obtained during initiation of production of radiation by the second radiative element whereby a said pulse of radiation from the first radiative element reduces the resistance of the first photoconductive element and thereby alters the potential of the said first electrode of the second radiative element in such a manner that the energisation potential applied between the said first and second electrodes is reduced to the point at which production of radiation by the second radiative element ceases.

2. A display arrangement as claimed in claim 1 in which the said means for connecting the said first selection line to a potential different from that obtained during initiation of production of radiation connect the said selection line to a potential substantially equal to the potential of the said second electrode of the second radiative element.

3. A display arrangement as claimed in claim 1 in which the said first and second radiative elements each comprise a d.c. electroluminescent element.

4. A display arrangement as claimed in claim 3 in which there is connected in parallel with the second radiative element a third radiative element consisting of a d.c. electroluminescent element which when energised produces light in the visible region, the second radiative element producing when energised radiation of a spectral distribution better matched to the sensitivity of the second photoconductive element than the third radiative element.

5. A display device comprising a plurality of display arrangements each as specified in claim 1, there being a plurality of first radiative elements each forming part of a plurality of the said display arrangements, there being a set of first selection lines and a set of second selection lines, and each pair of selection lines taken one from one of the said sets and the other from the other of the said sets having connected between it a plurality of series combinations each comprising a first radiative element and a second photoconductive element from one of a set of the said display arrangements, which set includes each first radiative element.

6. A display device as claimed in claim 5 in which the second radiative elements are arranged in cells, each cell containing, arranged in an array, all the second radiative elements included in display arrangements with a particular first radiative element.

7. A display device as claimed in claim 6 in which the first radiative elements are connected between two coordinate sets of selection lines.

8. A display device as claimed in claim 5 and comprising a multilayer panel, all the first photoconductive elements being arranged on one side of an opaque layer and all the second photoconductive elements being arranged on the other side of the said opaque layer, each pair of photoconductive elements included in a common said display arrangement having one terminal from each photoconductive element joined by an electrical connection through the opaque layer and connected to the first electrode of the second radiative element of that display arrangement.

9. A method of displaying and erasing information on a display which comprises:

carring out a selective illumination step comprising applying a pulse of radiation from a selected one of a plurality of first radiative elements so as to lower the resistances of a plurality of first photoconductive elements radiatively coupled to that first radiative element and, while the said resistances are so lowered, applying an energisation potential in parallel to a plurality of series combinations of a first photoconductive element and a second radiative element, one only of which first photoconductive elements is radiatively coupled to the said selected first element and has its resistance lowered as a result, the one second radiative element in series with that first photoconductive element being thereby subjected to an energising potential great enough to produce radiation, and maintaining the last-mentioned radiation by an energising potential applied to every second radiative element through a second photoconductive element in series with it and radiatively coupled to it, the magnitude of which potential is sufficient to cause any second radiative element to produce radiation if the resistance of the second photoconductive element is lowered by radiation from the second radiative element in series with it, but insufficient if the resistance is not so lowered, whereby the said one second radiative element is selectively illuminated; repeating the said selective illumination step so as to cause further selected second radiative elements to be illuminated;

and selectively erasing each illuminated second radiative element associated with a selected first radiative element by reducing the potential applied across every series combination of first photoconductive element and second radiative element from the value sufficient to initiate production of radiation and applying a pulse of radiation from that selected first radiative element to every first photoconductive element radiatively coupled to it so as to lower their resistances, the potential applied across the second radiative elements associated with that first radiative element being thereby reduced to the point at which production of radiation by each illuminated second radiative element associated with that first radiative element ceases to be maintained.

* * * * *